United States Patent [19]

Hackett-Jones

[11] 4,346,340

[45] Aug. 24, 1982

[54] METHOD AND MEANS FOR CONTROLLING THE FLUX DENSITY IN THE CORE OF AN INDUCTOR

[76] Inventor: Francis C. Hackett-Jones, "Seymour", Wouldham, Kent, England

[21] Appl. No.: 145,264

[22] Filed: Apr. 30, 1980

[51] Int. Cl.[3] ..... G05F 5/00

[52] U.S. Cl. ..... 323/249; 323/250; 323/302; 323/362

[58] Field of Search ..... 323/249–251, 323/254, 294, 301, 302, 329, 331, 362, 368

[56] References Cited

U.S. PATENT DOCUMENTS

| | | | |
|---|---|---|---|
| 2,736,822 | 2/1956 | Dunlap, Jr. | 323/368 X |
| 2,780,772 | 2/1957 | Lee | 323/329 |
| 2,979,668 | 4/1961 | Dunlap, Jr. | 323/368 X |
| 2,998,564 | 8/1961 | Lawrence, Jr. | 323/329 |
| 4,152,637 | 5/1979 | Oberbeck et al. | 323/250 |

*Primary Examiner*—William M. Shoop

*Attorney, Agent, or Firm*—Berman, Aisenberg & Platt

[57] ABSTRACT

In a method for the enhancement of the A.C. performance of an inductor such as a transformer or choke, the tendency of the core of the inductor to become saturated by flux arising from low frequency A.C. or D.C. currents flowing in the inductor winding is reduced by detecting the magnitude of such currents and applying to a control winding wound on the core of the inductor a compensating current in order to generate a magnetic flux in the core of the inductor which opposes the component of flux tending to cause saturation. An inductor to which the method may be applied may accordingly comprise a main winding, a magnetic core, a control winding, means for sensing the presence in said main winding of a current having a frequency below a predetermined limit, and means for applying to said control winding a control circuit tending to balance the flux generated by the sensed current.

8 Claims, 7 Drawing Figures

METHOD AND MEANS FOR CONTROLLING THE FLUX DENSITY IN THE CORE OF AN INDUCTOR

BACKGROUND OF THE INVENTION

This invention relates to a method and means for controlling the flux density in the core of an inductor such as a transformer or choke, in order to enhance the A.C. performance thereof in the presence of a direct or low frequency current circulating therein, and, if desired, to enable the magnitude of such a direct or low frequency current to be determined without any electrical contact being made to the circuit in which these currents flow.

It is well known that the strength of magnetic fields may be determined in a number of ways, for example, using devices which operate on the "Hall Effect" principle. It is also well known that direct current may be passed through control windings on, for example, magnetic amplifier transformers or inductors, enabling the magnetic circuit of such transformers or inductors to be saturated at will.

Many transformers and inductors used for example in the field of telecommunications, have to operate in the presence of relatively large direct circulating currents which result in high magnetic flux density levels within the core of the device. All magnetic core materials, including ferrites have a limiting flux density above which they cease to function satisfactory. This level is referred to as the "Saturation Flux Density" of the material which is a function of the material and its magnetic history. The magnetic flux density in the core is a function of the magnetising force (broadly the vector sum of the ampere turns in all windings), and the permeability of the core assembly. Although the alternating current performance of the transformer or inductor is enhanced by a highly permeable core assembly, effective permeability has frequently to be limited by the introduction of an air gap, or the use of magnetic material of inferior permeability to avoid exceeding the maximum saturation flux density of the material. The cross-sectional area of the core has also to be increased by a substantial factor to cater for the direct current flowing, beyond the area which would otherwise be needed to cater for the alternating currents of interest. This increases the size and cost of the transformer or inductor very considerably and generally degrades A.C. performance. Physical and economic limitation therefore often impose a technically undersirable design compromise. Similar considerations apply in the case of power supply filter chokes.

SUMMARY OF THE INVENTION

The present invention provides a method of controlling the flux density within the core of an inductor, which has applied to a winding thereof a first A.C. component of current and a second component of current which is D.C. or A.C. of a lower frequency than the first, comprising the steps of detecting the said second component of current and applying to a control winding of the inductor a control current in order to produce in the said core a magnetic flux tending to balance the magnetic flux generated by said second component of current, whereby saturation of the core of said inductor occurs at a greater amplitude of said first A.C. component of current than would be the case in the absence of said control current.

The said second component of current may be detected indirectly by detecting the magnetic flux in said core due to current components having a frequency below a predetermined frequency which is less than that of said first current component, or alternatively it may be detected directly by means of a current detecting element connected in series with the winding of the inductor.

The said method may, if desired, include the further steps of measuring the magnitude of said second component of current by controlling the magnitude of said control current to reduce to zero the magnetic flux due to said second component of current, and measuring the magnitude of the applied control current.

The invention further provides a device comprising, an inductor having a main winding, a magnetic core and a control winding, means for providing an output signal in response to a component of current flowing in said main winding, which component comprises a D.C. current or an A.C. current having a frequency below a predetermined frequency, and means responsive to said sensing means for selectively applying a control current to said control winding in a direction such as to produce in said core a magnetic flux opposing the magnetic flux due to said component of current, whereby the tendency of the inductor core to become saturated by a component of A.C. current having a frequency above said predetermined frequency is reduced. Preferably, said means for selectively applying a control current to said control winding comprises an amplifier having an output impedance which is high in relation to that of the said control winding, and said sensing means comprises a Hall effect element arranged to sense the magnetic flux in the core of said inductor and a low pass filter connected between said Hall effect element and the input to said amplifier.

DESCRIPTION OF THE PREFERRED EMBODIMENTS

Figure 1:
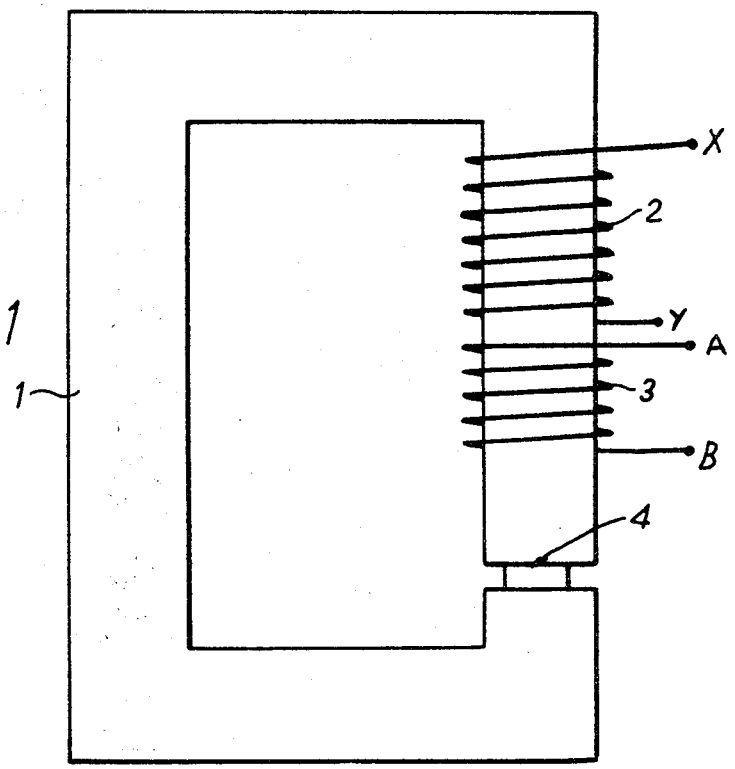
FIG. 1 is a diagrammatic view of an inductor for use in the method of the invention.
Figure 2:
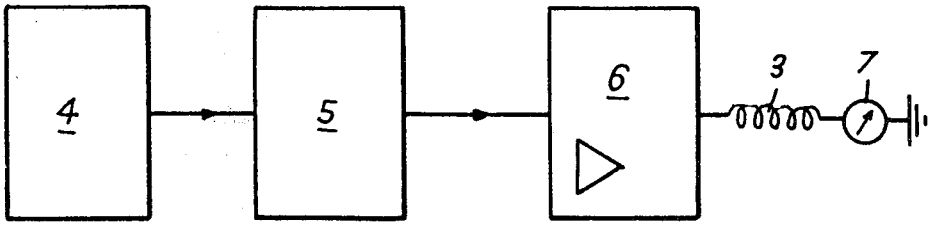
FIG. 2 is a block circuit diagram of a control circuit for control of the flux density in the magnetic core of an inductor such as shown in FIG. 1.

Referring to FIG. 1, there is illustrated diagrammatically a solenoid comprising a core 1, an energising winding 2 having terminals X and Y, a control winding 3 having terminals A and B, and a flux sensing member 4, for example a Hall element. FIG. 2 shows a control circuit for the solenoid of FIG. 1, wherein the flux sensing element 4 is connected to provide an output signal, via a low pass filter 5, to a D.C. amplifier 6 which has a high output impedance and is connected to supply an energising current to the control winding 3. A current measuring device is connected in series with the control winding 3. The operation of the circuit is as follows. Upon the application of an energising current I1 to the energising winding 2 of the solenoid, the corresponding magnetic flux induced in the core 1 will be sensed by the flux sensing means 4 which will provide a corresponding output signal. Any component of the current I1 below a frequency determined by the low pass filter 5 will therefore cause a corresponding signal to be applied to the amplifier 6, and thus a current I2 to be applied to the control winding 3. The amplifier 6 is connected to the control winding 3 in a sense such that the magnetic flux induced by the current passing through winding 3 is in opposition to that produced by the energising winding 2, and thus the system will tend towards a stable condition in which the respective components of magnetic flux balance one another and the resultant magnetic flux in the core 1 is zero.

By measuring the current flowing through the control winding 3, by means of the device 7, it is therefore possible to determine the magnitude of the component of current passing through energising winding 2 producing the magnetic flux which has been balanced. Thus:

$$I1=(N2)/(N1)\times I2,$$

where N1 is the number of turns of the windings 2, and N2 is the number of turns of the winding 3.

Figure 3:
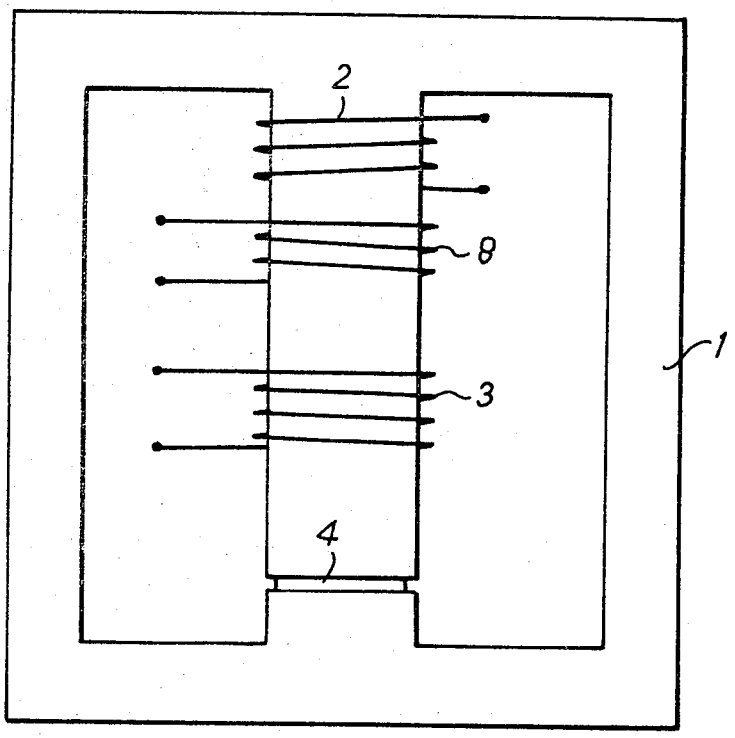
FIG. 3 is a view similar to FIG. 1 of another form of inductor for use in the method of the invention.

FIG. 3 is a view similar to FIG. 1 showing the application of the control circuit of FIG. 2 to a transformer. The operation of the arrangement is precisely the same as that described in respect of FIGS. 1 and 2, and similar components have been identified with the same reference numerals. The transformer has, however, in addition a secondary winding 8.

Figure 4:
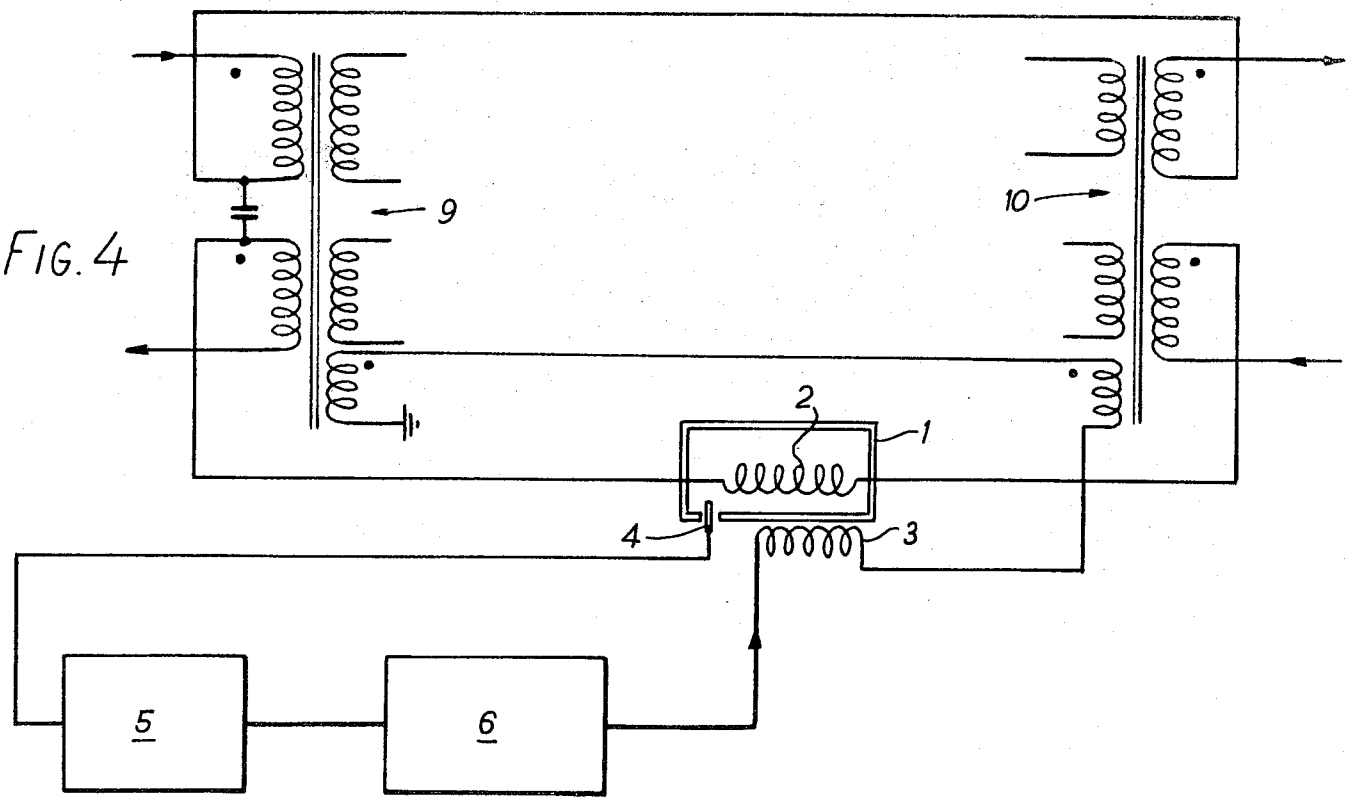
FIG. 4 is a circuit diagram of a device in accordance with the invention, and FIGS. 5A to 5C together make up a circuit diagram of a further embodiment of device in accordance with the invention.

FIG. 4 shows an arrangement wherein a separate inductor connected in series with primary windings of transformers 9 and 10 may be used to effect indirect control of the flux density within the cores of the transformers 9 and 10 by way of control windings connected in series with the control winding 3 of the separate inductor. The components and operation of the circuit are otherwise as illustrated in FIGS. 1 and 2, and like components are indicated by like reference numerals.

Figure 5A:
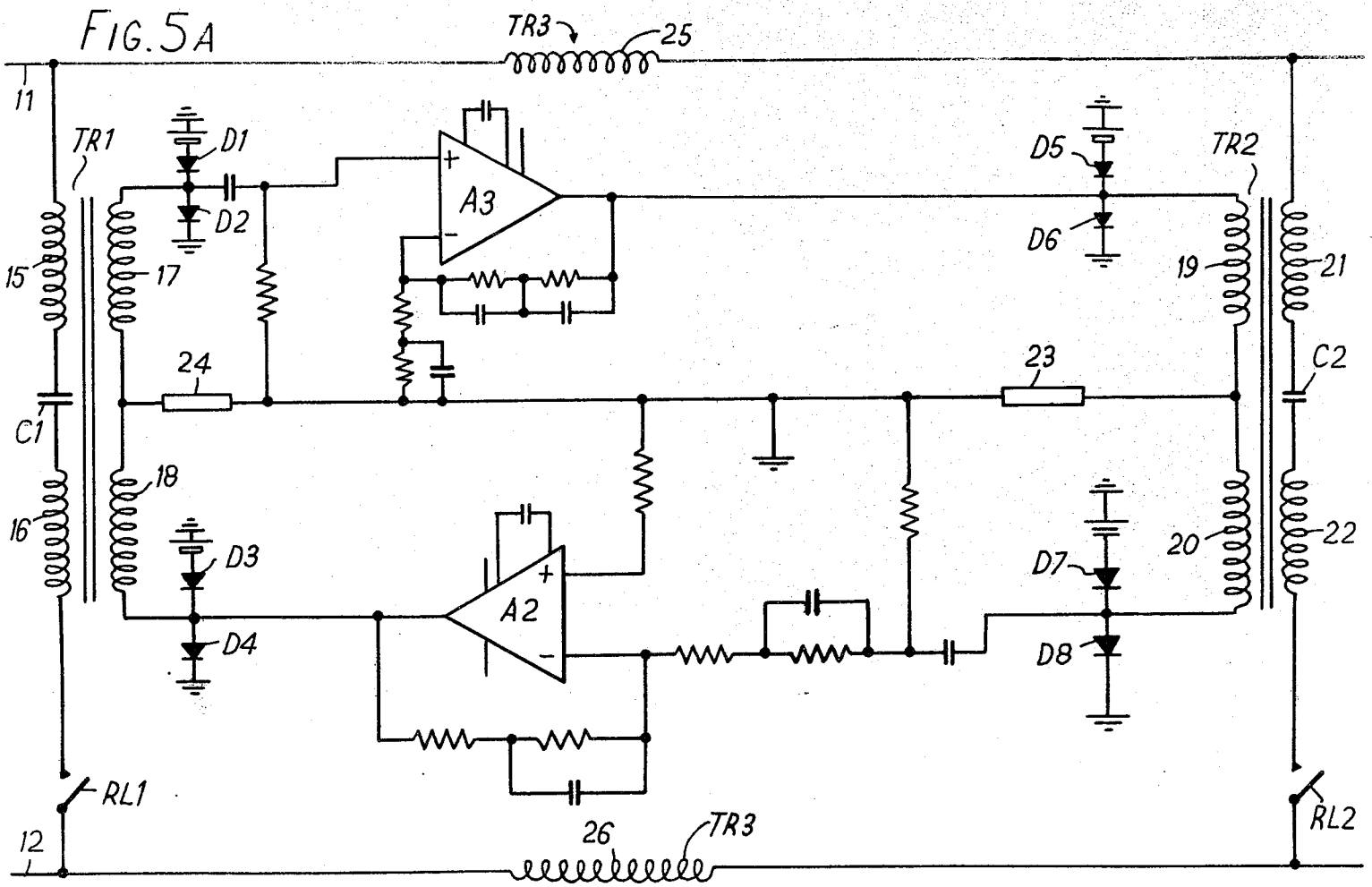
Figure 5B:
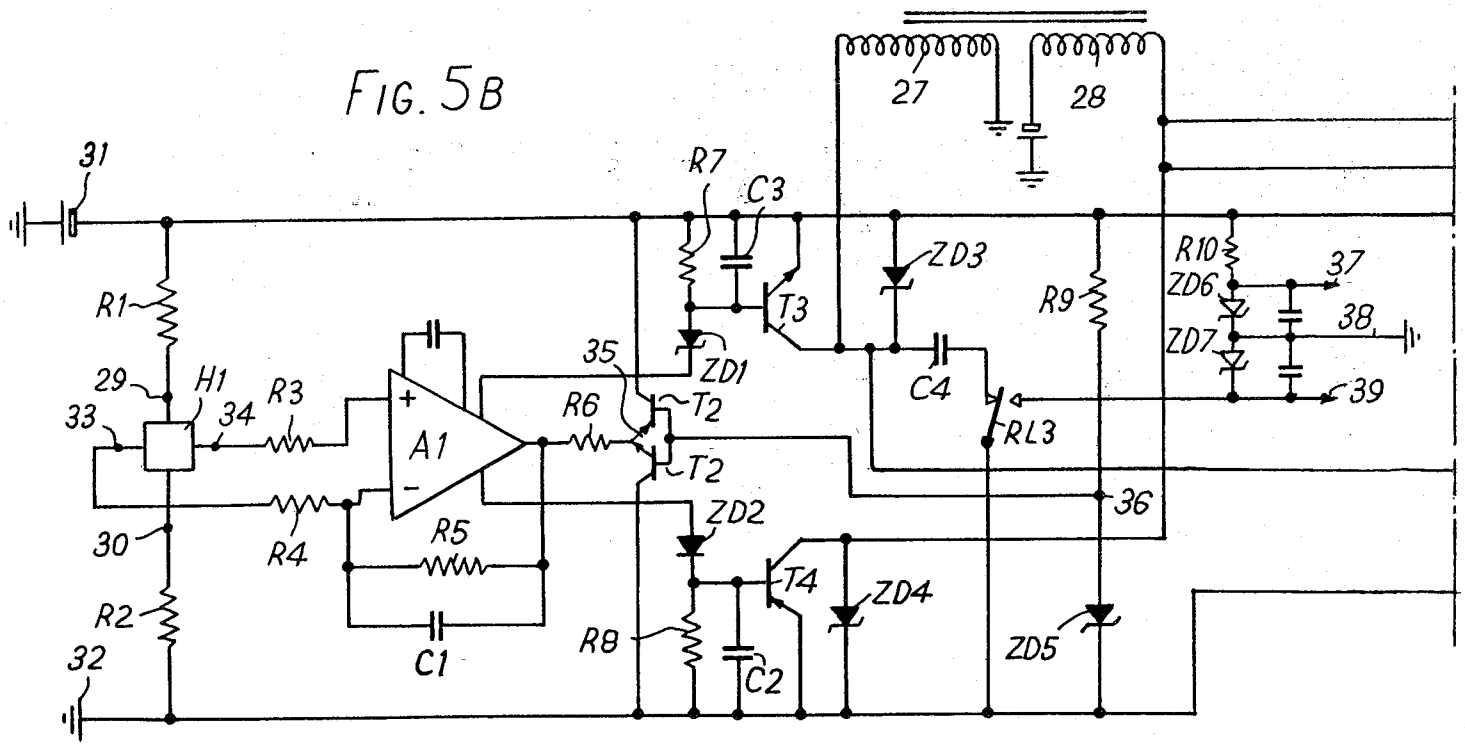
Figure 5C:
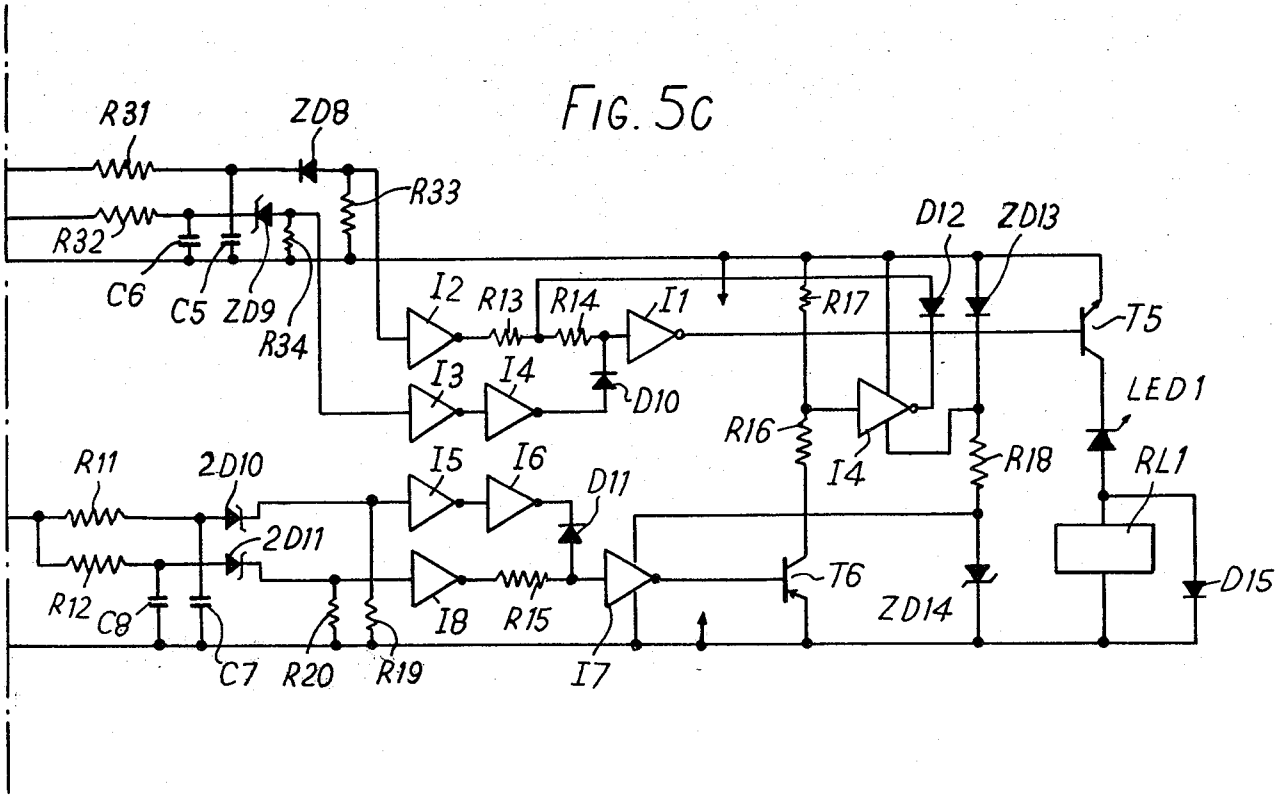

A practical example of an arrangement in accordance with the invention is illustrated in more detail in FIGS. 5A to C, which together make up a circuit diagram of a line extender designed to provide amplification of audio frequencies in a two wire telephone line such as may be used to link a telephone subscriber to an exchange, the circuit being adapted to detent and to provide compensation for D.C. current flowing in an audio frequency choke of the circuit.

The circuit of FIGS. 5A to C may be divided into sections illustrated respectively in FIGS 5A to C as follows.

FIG. 5A shows a line extender circuit providing audio amplification for voice freqeuncy signals whilst at the same time providing a non-amplified path for D.C. line signals.

FIG. 5B shows a circuit for detecting and compensating D.C. line current flowing in the circuit of FIG. 5A, and FIG. 5C shows a control circuit which is responsive to the compensating signals of the circuit of FIG. 5B in order to effect controlled switching of the audio amplifiers of the circuit of FIG. 5A when the D.C. line current lies within predetermined limits.

Referring now to FIG. 5A, the circuit shown is intended to be connected between telephone exchange terminals 11 and 12 and terminals 13 and 14 of a telephone line served by the exchange. Operational amplifiers A2 and A3 are arranged to provide voice frequency amplification for signals passing respectively from the subscriber towards the exchange and from the exchange to the subscriber. Transformers TR1 and TR2 are connected in a hybrid configuration, in known manner, in order to provide mutual separation of the amplified directional speech paths provided by amplifiers A2 and A3. Each of the hybird transformers comprises four transformer windings 15, 16, 17, 18 and 19, 20, 21, 22 respectively, and connected in series between windings 15 and 16 of TR1 is a capacitor C1, a capacitor C2 likewise being connected between windings 21 and 22 of transformer TR2. The capacitors C1 and C2 serve to block the respective transformer windings to D.C. line current flowing in the telephone wires. Transformer winding 20 of transformer TR2 is connected to the input of amplifier A2 via a line balancing network indicated diagrammatically at 23, whereas the output of amplifier A2 is connected to transformer winding 18 via an exchange balancing network indicated diagrammatically at 24. The input and output of amplifier A3 are connected in similar manner to transformer winding 17 of TR1 and transformer winding 19 of transformer TR2. The hybrid circuit is generally of conventional type, and the operation thereof will not therefore be described in further detail. Diodes D1 to D8 are provided to protect the amplifier circuits from high induced voltages.

An audio frequency choke TR3 has windings 25 and 26 connected to bypass the transformers TR1 and TR2 and thus to provide a conduction path between the telephone exchange and the telephone line for direct line current. These windings are low in resistance to minimise the effect on loop current and are so connected as to aid the magnetic field in the core when a current flows in the loop. In accordance with the magnitude of the current flowing in the choke windings, operation of the amplifiers A2 and A3 is controlled via a relay of the control circuit referred to below. This relay also controls relay contacts RL1 and RL2 in order to open-circuit the transformers TR1 and TR2 when the line extender circuit is not in operation, so that capacitors C1 and C2 do not interfere with ringing and line testing currents.

Referring now to FIG. 5B, it will be seen that the choke TR3 also has two control windings 27 and 28 which are wound on a common core with the windings 25 and 26, and through either of which a compensating direct current can be passed by means of the circuit of FIG. 5B in order to cancel the direct component of flux in the core due to loop current flowing in windings 25 and 26. A Hall effect device H1 is embedded in the magnetic core of the choke TR3, in a similar manner to the element 4 as described above with reference to FIG. 3.

Terminals 29 and 30 of the device H1 are connected in series with the exchange battery terminals 31 and 32 via resistors R1 and R2 which set the exciting current for the device. Hall voltage output terminals 33 and 34 of the element H1 are connected via resistors R3 and R4 to the respective inputs of an operational amplifier A1, of which the output is connected via a resistor R6 to a low impedance voltage reference point 35 provided at the tapping between series connected connector/emitter paths of respective transistors T1 and T2, of which the bases are connected to a tapping 36 between a resistor R9 and Zener diode D5 which are also connected in series across the exchanger battery terminals 31 and 32.

The current supply terminals of the operational amplifier A1 are connected to the exchange battery terminals via resistor R7 and Zener diode D1 and resistor R8 and Zener diode D2, respectively. The Zener diodes D1 and D2 serve to limit the supply voltage imposed on the operational amplifier A1. The tapping between resistor R7 and Zener diode D1 is connected to the base of a transistor T3 which forms a high impedance voltage driver controlling current flow through the winding 27 of choke TR3. The tapping between resistor R8 and diode D2 is likewise connected to the base of a similar transistor T4 controlling current flow through the winding 27 of choke TR3. The tapping between resistor R8 and diode D2 is likewise connected to the base of a similar transistor T4 controlling current flow through winding 28 of the choke TR3. Zener diodes D3 and D4 are connected in parallel with the collector/emitter current paths of transistors T3 and T4, respectively, in order to protect the transistors from damage due to high voltage transients.

A changeover relay contact RL3 of a control relay referred to below is connected to the exchange battery earth terminal 32, and is arranged on the one hand to complete a circuit via capacitor C4 shunting the winding 27 of choke TR3, and on the other hand to complete a connection to a current supply circuit formed by series connected resistor R10 and Zener diodes ZD6 ad ZD7, which form a voltage divider circuit providing voltage output terminals 37, 38 and 39 for connection to the current supply terminals of operational amplifiers A2 and A3.

The control circuit of FIG. 5C comprises a relay RL1 connected in series with a light emitting diode LED1 and a transistor T5 to the exchange battery terminals. The base of transistor T5 is connected to the output of an inverter I1 which serves to control the conductive state of the transistor T5. Connected in parallel with the winding 28 of choke TR3 is a first voltage sensing circuit formed by a resistor R31, a Zener diode ZD8 and a resistor R33 connected in series, and a capacitor C5 connected in parallel with Zener diode ZD8 and resistor R33. A second voltage sensing circuit formed in a similar manner by resistor R32, Zener diode ZD9, resistor R34 and capacitor C6 is connected in parallel with the first. The tapping between Zener diode ZD8 and resistor R33 of the first voltage sensing circuit is connected via inverter I2 and series connected resistors R13 and R14 to the input to inverter I1, whereas the tapping between Zener diode ZD9 and resistors R34 of the second voltage sensing circuit is connected to the input of inverter I1 via inverters I3 and I4 and diode D10.

In a similar manner there are connected in parallel with winding 27 a voltage sensing circuit formed by resistor R11, Zener diode ZD10, resistor R19 and capacitor C7, and a voltage sensing circuit comprising resistor R12, Zener diode ZD11, resistor R20 and capacitor C8. The tapping between Zener diode ZD10 and resistor R19 is connected via inverters I5 and I6, diode D11 and inverter I7 to the base of a transistor T6. The tapping between Zener diode ZD11 and resistor R20 is connected via inverter I8 and resistor R15 also to the input of inverter I7.

The connector emitter path of transistor T6 is connected in series with resistors R16 and R17 to the battery potential, and the tapping between resistors R16 and R17 is connected to the input of a further inverter I9, the output of which is connected via diode D12 to the tapping between resistors R13 and R14. Voltage supplies to the respective inverters are provided via Zener diodes ZD13 and ZD14, and resistor R18, only the connectors to inverters I7 and I9 being illustrated for clarity.

The operation of the complete circuit will now be described as follows. The respective operational amplifiers A2 and A3 provide for amplification of voice signals appearing on the telephone circuits in both directions simultaneously, and the amplification circuit relies on its stability for the capacity of the hybrid transformer arrangement provided by transformers TR1 and TR2 to isolate the two paths sufficiently to prevent "singing." This places high demands upon the performance of transformers TR1 and TR2, and to enable the required transformer performance to be achieved all direct line current is by-passed around the amplifier circuits by means of the windings 25 and 26 of the choke TR3. In turn, the choke windings 25 and 26 must provide a high degree of voice frequency isolation between the exchange terminals 11 and 12 and the line terminals 13 and 14 to prevent positive feedback or "singing" from occurring. Moreover, control of the amplifiers A2 and A3 is necessary so that the amplifiers are actuated only when the line current is greater than, for example 10 milliamps, and not more than, for example, 60 milliamps, to ensure stability under open circuit conditions and also in the circumstances where low impedance loads or short circuit conditions may be applied to the line terminals of the line extender. The performance of the choke windings 25 and 26 must in addition be maintained during the flow of such line currents in such a manner that the impedance of the windings 25 and 26 presented to audio frequency currents is not reduced by saturation of the choke core in the presence of the direct line current.

By means of the control windings 27 and 28 of the choke TR3, and the associated circuitry, monitoring of the direct line current is enabled, while simultaneously the tendency of the audio frequency performance of the choke TR3 to be adversely affected by such line currents is reduced. This is achieved in the following manner. When the direct line current flowing in windings 25 and 26 of the choke TR3 is less than approximately 10 milliamps or more than approximately 60 milliamps, indicating either open circuit conditions or that the line terminals of the line extender are subject to a low impedance load, the control circuit of FIG. 5C to be described below causes relay RL to be deenergised so that the relay contacts RL1, RL2 and RL3 are in the positions illustrated in the drawing. Thus the hybrid circuit provided by transformers TR1 and TR2 is inoperative, no power is supplied to amplifiers A2 and A3, and winding 27 of choke TR3 is shunted via capacitor C4, thus minimising the voice frequency insertion loss of the line extender when it is not amplifying, e.g. when it is employed on a very short telephone line.

Assuming that a direct line current is flowing in choke windings 25 and 26, the corresponding magnetic flux set out in the core of choke TR3 will result in a control voltage appearing at terminals 33 and 34 of the Hall effect device H1 in accordance with the direction of the detected flux and the corresponding polarity of the voltage at terminals 33 and 34 an increased current will be caused to flow in a respective one of the current supply circuits of the operational amplifier A1, thus increasing the current flow through the respective one of transistors T3 or T4 so that a compensating current flows in the choke winding 27 or 28, and there is produced in the core of choke TR3 a reverse magnetic flux tending to cancel the magnetic flux due to the direct line current. Assuming that such a current is caused to flow, for example, in choke winding 28, there will be a correspondingly increased voltage drop across this winding and capacitors C5 and C6 will become charged via resistors R31 and R32. The breakdown voltage of Zener diode ZD8 is lower than that of diode ZD9, and when capacitor C5 becomes charged to this voltage to diode ZD8 conducts and a positive voltage pulse is transmitted to the input of inverter I2. The inverter I2 will respond by providing an output voltage at its negative logic level, and inverter I1 will provide a positive output voltage causing transistor T5 to become conductive and relay RL1 to be energised. This occurs at a current flow in the line circuit of approximately 10 milliamps. Upon response of the relay RL1 the relay contacts RL1 and RL2 are closed to render the hybrid circuit operative, and contact RL3 is changed over to cause power to be applied to the amplifiers A2 and A3 and at the same time to remove the shunt across winding 27 of the choke TR3 so that the AC impedance of windings 25 and 26 is increased to provide audio frequency isolation between the respective inputs and outputs of the hybrid circuit. The line extender thus provides effective audio frequency amplification between the exchange and line terminals, whilst magnetic flux in the core of the choke 23 due to the direct line current is cancelled by the reverse flux due to the compensating current flowing in the winding 28, and the audio frequency performance of the choke is maintained.

If the direct line current flowing in the choke windings 25 and 26 should increase above a level of approximately 60 milliamps, then the compensating current flowing in winding 28 will be correspondingly increased, and capacitor C6 will become charged to the point where breakdown voltage of Zener diode ZD9 is reached. A positive voltage pulse is thus applied at the input to inverter I3 causing a negative voltage signal to appear at the output thereof, whereupon inverter I4 applies a positive signal directly to the input of inverter I1 via diode D10. The corresponding negative output signal applied at the base of transistor T5 from inverter I1 thus turns transistor T5 off deenergising relay RL1 and returning the circuit to its idle condition. Thus the line extender circuit is disabled in the event that it is subject to a low line impedance indicative of a short telephone line not requiring the insertion of amplification.

The above description assumes that the compensation current applied to choke TR3 is caused to flow in winding 28. If, on the other hand, due to a reverse polarity the compensating current is caused to flow in winding 27, then the voltage drop across winding 27 causes a similar response of the voltage sensing circuits formed by components R11, ZD10, R19, C7, R12, ZD11, R20, C8, I5, I6, I7, I8 and D11, whereby the conductivity of transistor T6 is controlled in a manner analogous to that of transistor T5. In this case, a voltage signal is applied from the tapping between resistors R16 and R17 to the input of inverter I9, the output signal of which is applied via diode D10 to the tapping between resistors R13 and R14. Transistor T5 is thus controlled in a similar manner as before via inverter I1.

I claim:

1. A method of controlling the flux density within the core of an inductor which has applied to a winding thereof a first A.C. component of current and a second component of current which is D.C. or A.C. of a lower frequency than the first, comprising the steps of detecting the said second component of current and applying to a control winding of the inductor a control current in order to produce in the said core a magnetic flux tending to balance the magnetic flux generated by said second component of current, whereby saturation of the core of said inductor occurs at a greater amplitude of said first A.C. component of current than would be the case in the absence of said control current.

2. A method as claimed in claim 1, wherein the said second component of current is detected indirectly by detecting the magnetic flux in said core due to current components having a frequency below a predetermined frequency which is less than that of said first current component.

3. A method as claimed in claim 1, wherein the said second component of current is detected by directly detecting the current flowing in said winding of the inductor.

4. A method as claimed in claim 1 or 3 wherein the said second component of current is detected by detecting the magnetic flux generated in a further inductors connected in series with the said winding of the inductor.

5. A method as claimed in claim 2, including the further steps of measuring the magnitude of said second component of current controlling the magnitude of said control current to reduce to zero the magnetic flux due to said second component of current, and measuring the magnitude of the applied control current.

6. A device comprising, an inductor having a main winding, a magnetic core and a control winding, sensing means for providing an output signal in response to a component of current flowing in said main winding, which component comprises a D.C. current or an A.C. current having a frequency below a predetermined frequency, and means responsive to said sensing means for selectively applying a control current to said control winding in a direction such as to produce in said core a magnetic flux opposing the magnetic flux due to said component of current, whereby the tendency of the inductor core to become saturated by a component of A.C. current having a frequency above said predetermined frequency is reduced.

7. A device as claimed in claim 1, in which said means for selectively applying a control current to said control winding comprises an amplifier having an output impedance which is high in relation to that of the said control winding, and said sensing means comprises a Hall effect element arranged to sense the magnetic flux in the core of said inductor and between said Hall effect element and the input to said amplifier.

8. A device as claimed in claim 7, in which said means for selectively applying a control current to said control winding comprises an amplifier having an output impedance which is high in relation to that of the said control winding, said device includes a further inductor having a main winding connected in series with the main winding of the first inductor, a magnetic core and a control winding connected in series with the said control winding of said first inductor, and said sensing means comprises a Hall effect element arranged to sense the magnetic flux in the core of said further inductor and a low pass filter connected between said Hall effect element and the input to said amplifier.

* * * * *